US005690523A

United States Patent [19]

Yu

[11] Patent Number: 5,690,523

[45] Date of Patent: Nov. 25, 1997

[54] FLOATS

[76] Inventor: Meng-Hua Yu, No. 536-1, Ta Chin Street, Taichung, Taiwan

[21] Appl. No.: 717,010

[22] Filed: Sep. 20, 1996

[51] Int. Cl.[6] ..... B63B 35/58

[52] U.S. Cl. ..... 441/35; 114/263; 114/266

[58] Field of Search ..... 114/263, 266, 114/267, 45, 46, 262; 441/35; 14/27; 405/219

[56] References Cited

U.S. PATENT DOCUMENTS 3,102,503 9/1963 Sheffield ..... 114/266

4,078,515 3/1978 Svirklys ..... 114/266

4,768,456 9/1988 Jones et al. ..... 114/266

5,529,013 6/1996 Eva et al. ..... 114/266

*Primary Examiner*—Stephen Avila

*Attorney, Agent, or Firm*—Charles E. Baxley, Esq.

[57] ABSTRACT

A float includes a hollow main body having four upper corners each having a first recess defined in therein, a cavity defined below the first recess, and a lug extending outwardly therefrom at a position below the cavity. The hollow main body further includes a second recess defined in an upper side thereof. An anti-slip cover is removably mounted to the second recess.

1 Claim, 7 Drawing Sheets

FLOATS

BACKGROUND OF THE INVENTION

The present invention relates to a float which provides a connection between the water and the shore and, more particularly, to a float which includes an anti-slip surface to avoid people slipping during walking thereon. The present invention also relates to a float which includes a removable cover to allow access to ropes, wires, and/or cables mounted therethrough for easy maintenance.

Floats may provide an additional space for people to move on water, and most of them are integrally formed by blowing. However, upper surfaces of the floats so formed are somewhat convex instead of being flat and thus may people walking thereon to slip. Even if protuberant patterns are provided on the upper surfaces of the floats, the anti-slip effect is poor as the floats are placed near the shore and the upper surfaces often have water thereon. In addition, wires and/or cables are often mounted to the floats to provide illumination, yet there is no suitable place for mounting the wires and cables. The present invention is intended to provide an improved float which mitigates and/or obviates the above problems.

SUMMARY OF THE INVENTION

In accordance with an embodiment of the invention, a float comprises a hollow main body having four upper corners each having a first recess defined in therein, a cavity defined below the first recess, and a lug extending outwardly therefrom at a position below the cavity, the lug having a hole defined therein. The hollow main body further comprises a second recess defined in an upper side thereof. An anti-slip cover is removably received in the second recess. Preferably, the anti-slip cover includes protuberant patterns formed on an upper side thereof to provide the required anti-slip function.

In a second embodiment of the invention, a bottom surface defining the second recess includes two intersecting grooves defined therein through which ropes, wires, and/or cables are extended. Preferably, four corners at an intersection of the intersecting grooves are beveled to avoid damage to the ropes, wires, and/or cables.

Other objects, advantages, and novel features of the invention will become more apparent from the following detailed description when taken in conjunction with the accompanying drawings.

DESCRIPTION OF THE PREFERRED EMBODIMENT

Figure 1:
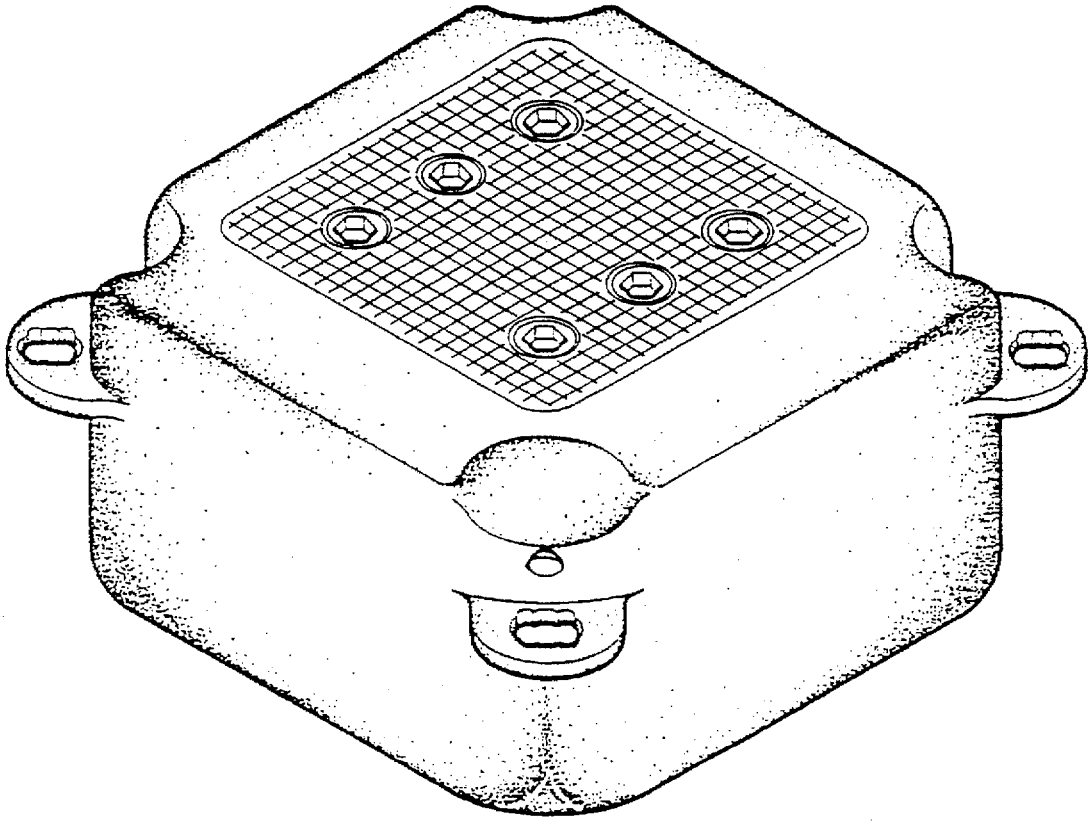
FIG. 1 is a perspective view of a first embodiment of a float in accordance with the present invention.
Figure 2:
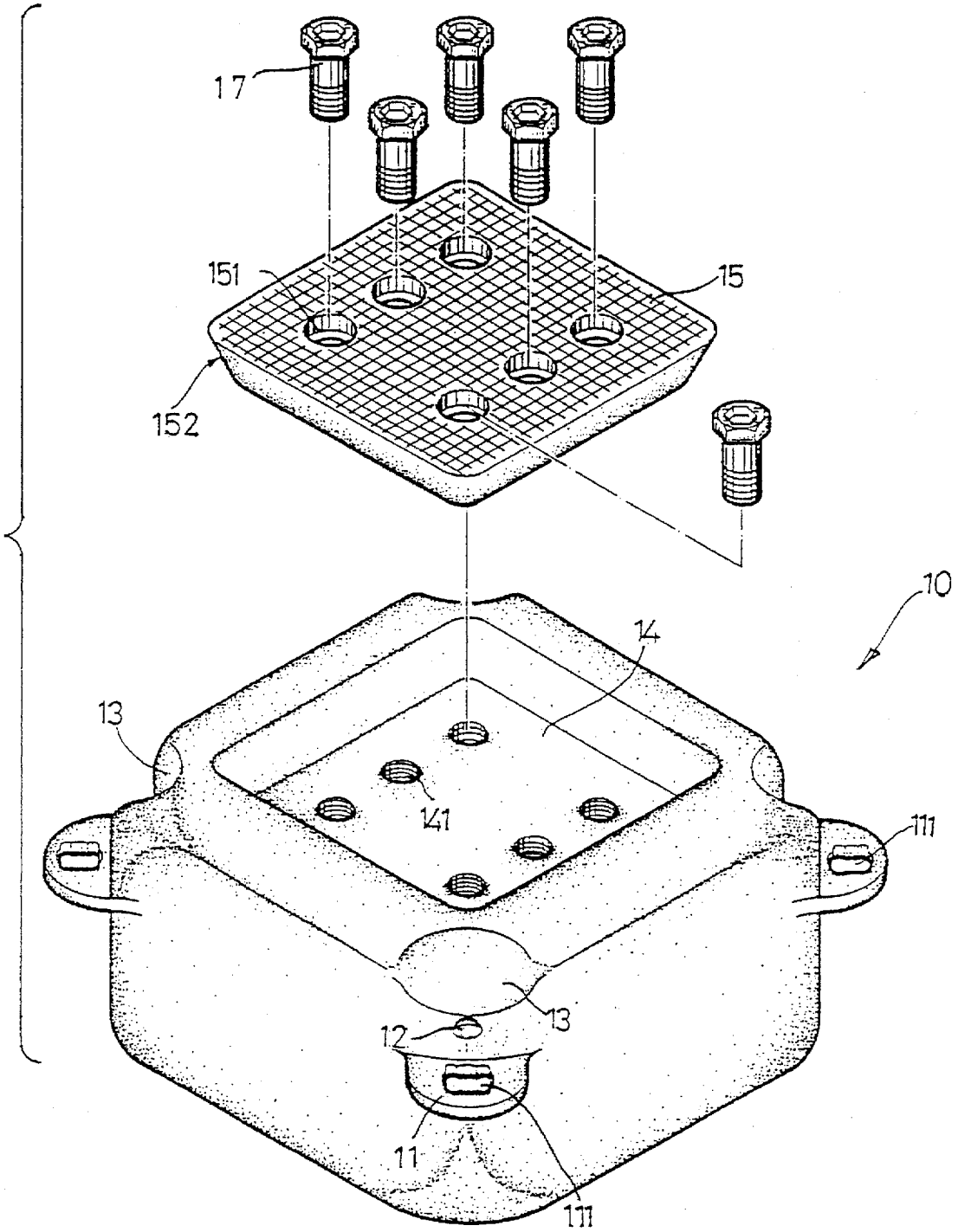
FIG. 2 is an exploded perspective view of the float in FIG. 1.
Figure 3:
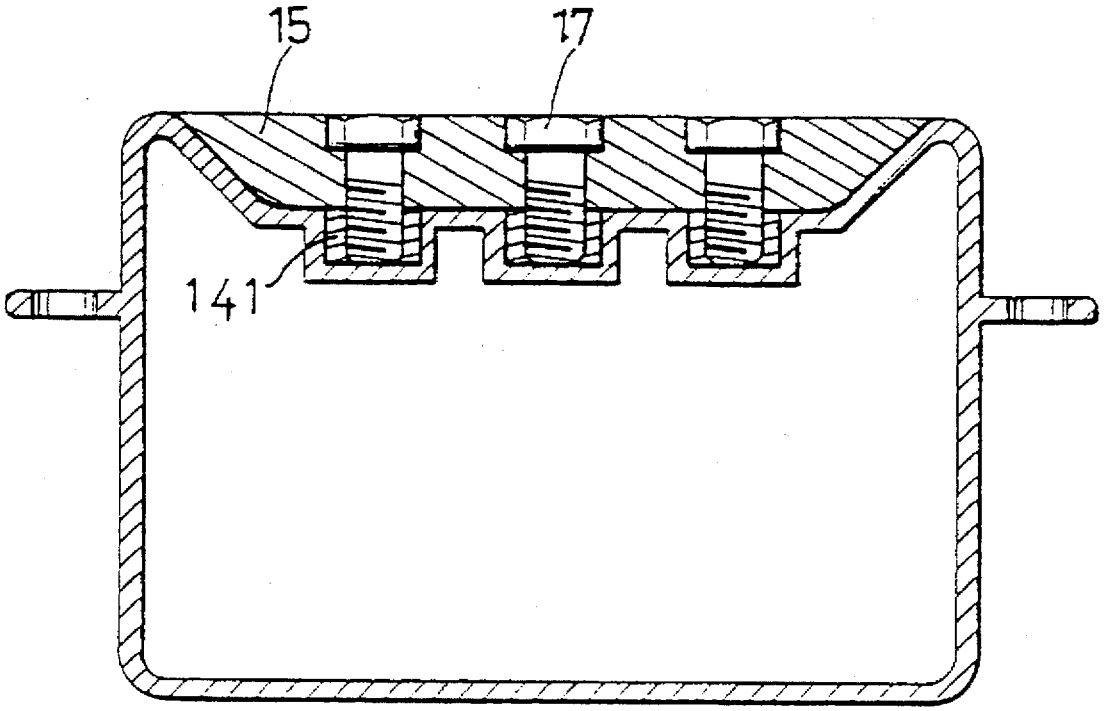
FIG. 3 is a cross-sectional view of the float in FIG. 1.

Referring to the drawings and initially to FIGS. 1 to 3, a float in accordance with the present invention includes a hollow main body 10 having four upper corners each having a recess 13 defined therein. A cavity 12 is defined below each recess 13 and a lug 11 extends outwardly at a position below the cavity 12 and having a hole 111 defined therein. It is appreciated that the recess 13, the cavity 12, and the lug 11 are used for interconnection with another float and are not further described as being conventional.

The hollow float main body 10 further comprises a second recess 14 defined in an upper side thereof, and a bottom surface defining the second recess 14 includes a plurality of screw holes 141 defined therein. An anti-slip cover 15 is removably received in the second recess 14 by extending bolts 17 through screw holes 151 defined in the anti-slip cover 15 and the associated screw holes 141. Preferably, four sides 152 of the anti-slip cover 15 may be beveled such that the anti-slip cover 15 can be easily mounted to and dismantled from the hollow main body 10. Preferably, the anti-slip cover 15 includes protuberant patterns formed on an upper side thereof to provide the required anti-slip function. It is appreciated that the anti-slip cover 15 can be made of a material different from that of the hollow main body 10, for example, the anti-slip cover 15 can be made of rubber or other material having a greater frictional coefficient. Thus, the anti-slip cover 15 can be made separately from the main body 10. This is advantageous as the material and weight of the float is less limited when taking formation of the anti-slip patterns on the integrally formed float into consideration.

Figure 4:
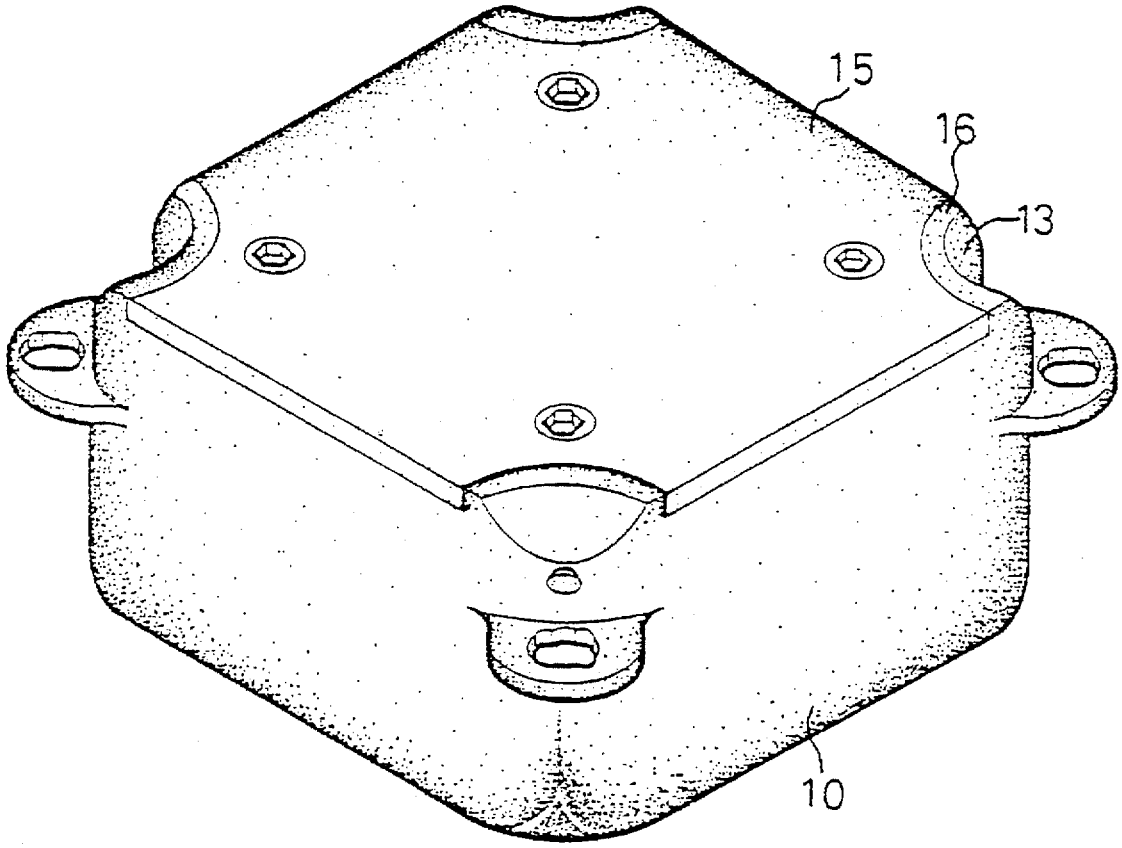
FIG. 4 is a perspective view illustrating a modified embodiment of the float.

FIG. 4 shows a modified embodiment in which the area of the second recess (not specifically shown) is extended to cover an area between four arcuate flanges 16 which respectively form a wall defining the associated recess 13.

Figure 5:
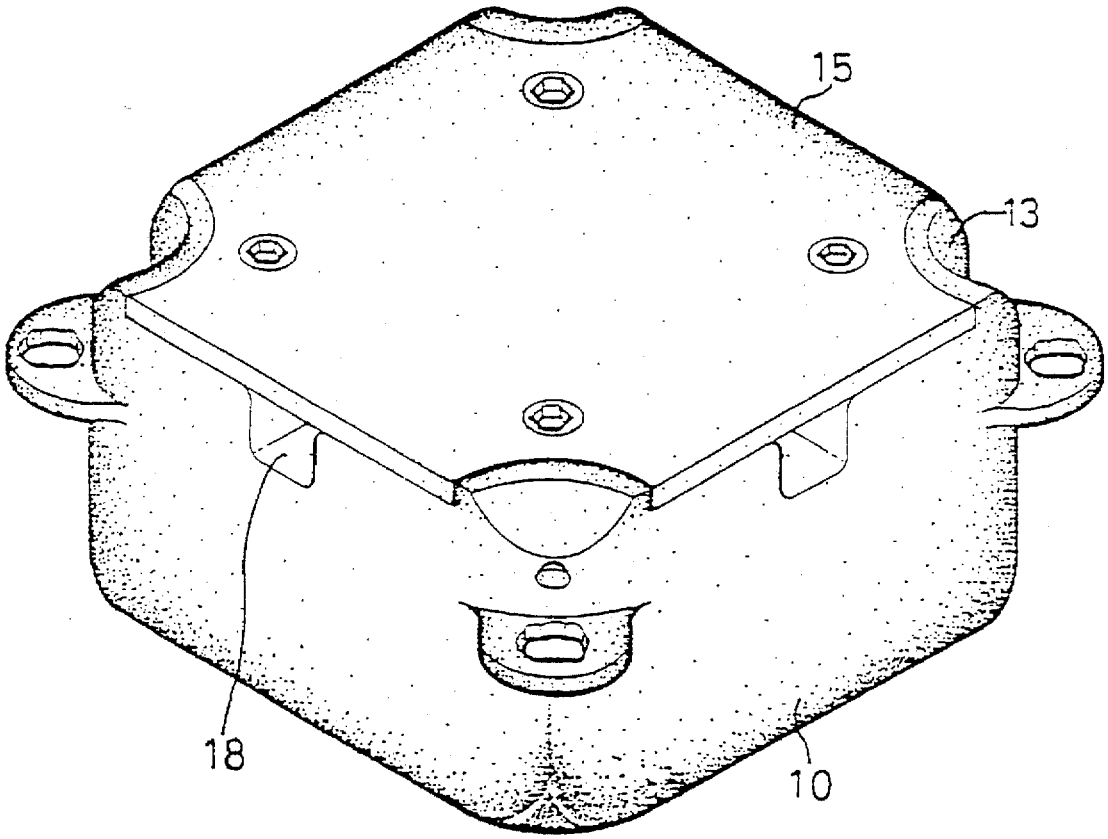
FIG. 5 is a perspective view of a second embodiment of a float in accordance with the present invention.
Figure 6:
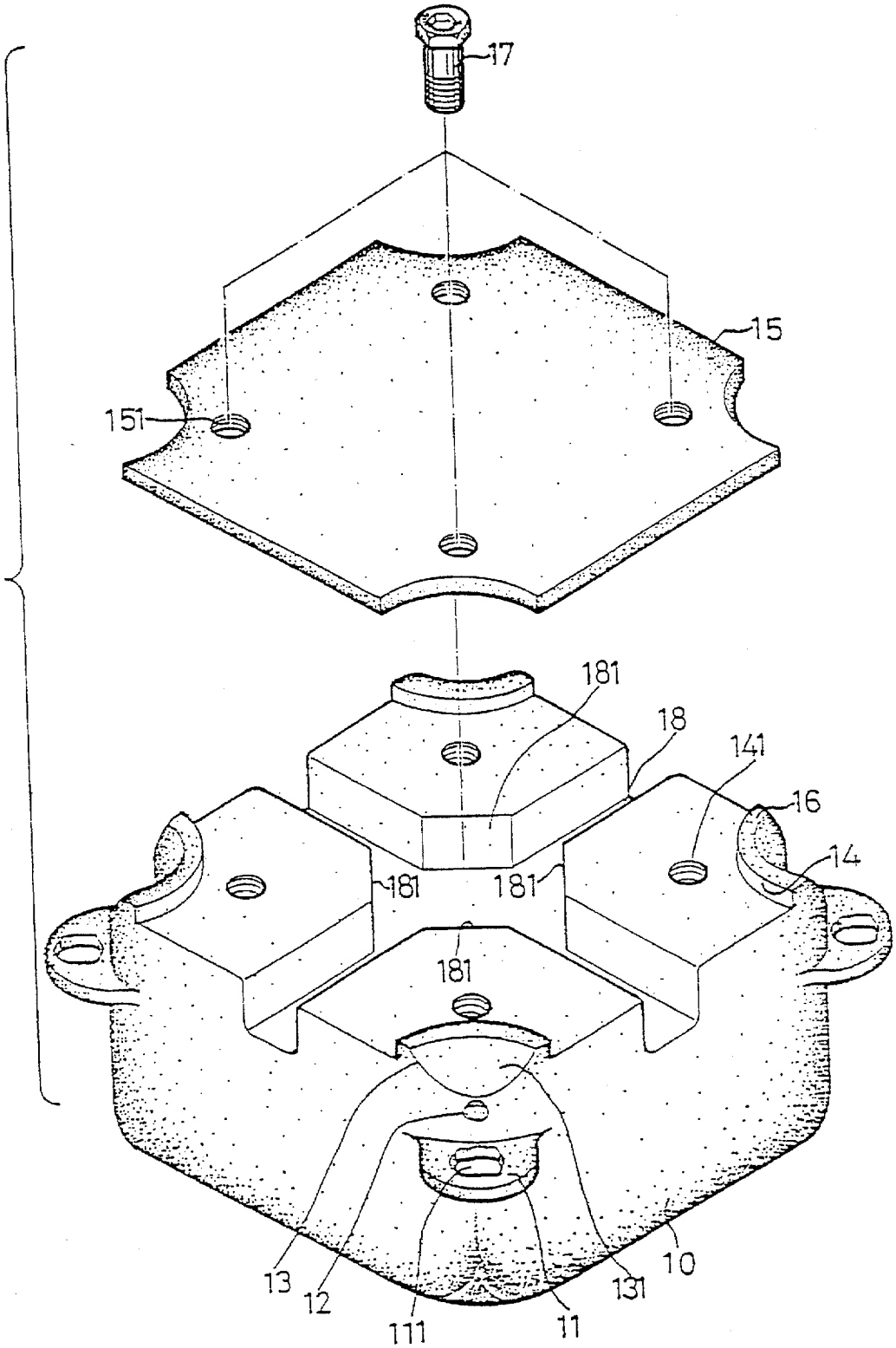
FIG. 6 is an exploded perspective view of the float in FIG. 5.
Figure 7:
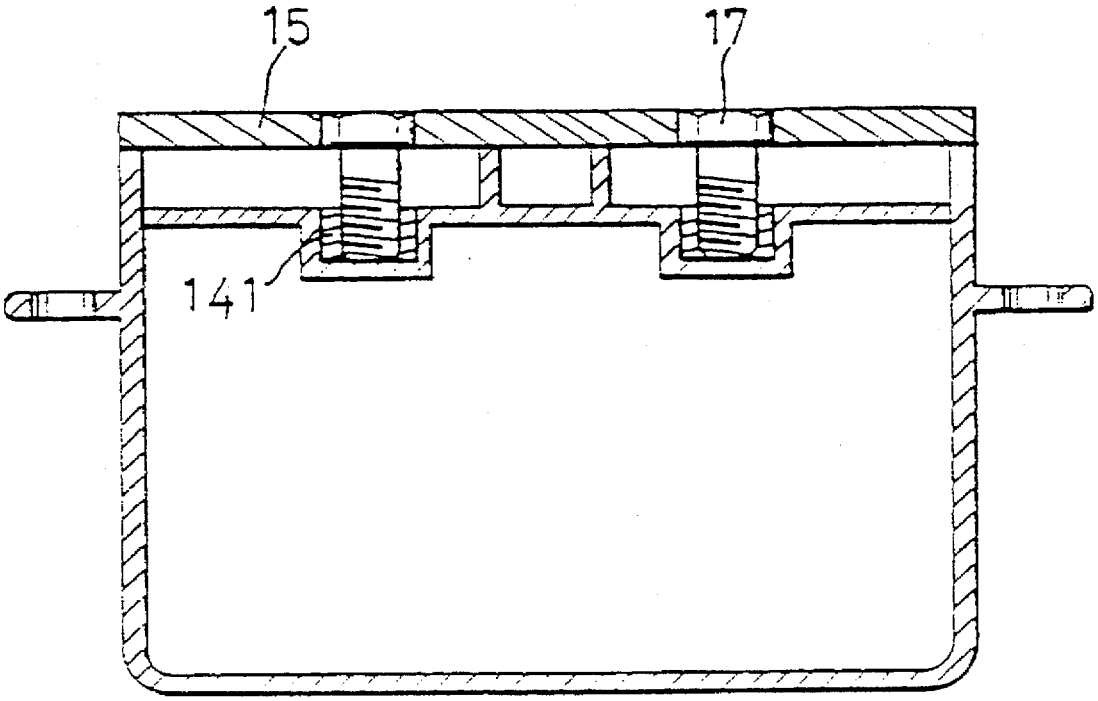
FIG. 7 is a cross-sectional view of the float in FIG. 5.

Referring to FIGS. 5 to 7, in a second embodiment of the invention, the bottom surface defining said second recess 14 includes two intersecting grooves 18 (See FIG. 6) defined therein through which ropes, wires, and/or cables extend. This is advantageous, for example, after having bulbs connected to the wires, illumination can be provided. As shown in FIG. 6, four corners 181 at an intersection of the intersecting grooves 18 are beveled to avoid damage to the ropes, wires, and cables. It is appreciated that the anti-slip cover 15 is removably mounted to the main hollow body 10 and thus provides easy access to the ropes, wires, and cables for maintenance.

Although the invention has been explained in relation to its preferred embodiment, it is robe understood that many other possible modifications and variations can be made without departing from the spirit and scope of the invention as hereinafter claimed.

I claim:

1. A float comprising:

a hollow main body having four upper corners, each said upper corner having a first recess defined therein, a cavity defined below each said first recess, and a lug extending outwardly therefrom at a position below each said cavity, said lug having a hole defined therein, said hollow float main body further comprising a second recess defined in an upper side thereof, a bottom surface defining said second recess including two intersecting grooves defined therein, four corners at an intersection of the intersecting grooves being beveled; and an anti-slip cover removably received in said second recess, said anti-slip cover including protuberant patterns on an upper side thereof, said anti-slip cover having a plurality of through holes defined therein, and fasteners being extended through the through holes, thereby removably mounting said anti-slip cover in said second recess.

* * * * *